US008209774B2

(12) United States Patent
Baacke et al.

(10) Patent No.: US 8,209,774 B2
(45) Date of Patent: Jul. 3, 2012

(54) COATED GLOVE WITH MULTIPLE MATERIAL LAYERS

(75) Inventors: Dennis R. Baacke, Irma, WI (US); Steven Van Ermen, Ada, MI (US)

(73) Assignee: Li & Fung (B.V.I.) Ltd. (VG)

( * ) Notice: Subject to any disclaimer, the term of this patent is extended or adjusted under 35 U.S.C. 154(b) by 522 days.

(21) Appl. No.: 12/355,435

(22) Filed: Jan. 16, 2009

(65) Prior Publication Data

US 2009/0183298 A1 Jul. 23, 2009

Related U.S. Application Data

(60) Provisional application No. 61/022,561, filed on Jan. 22, 2008.

(51) Int. Cl.
*A41D 19/00* (2006.01)

(52) U.S. Cl. ..... 2/161.6

(58) Field of Classification Search ..... 66/174; 2/159, 161.1, 161.6, 161.7, 161.8, 160, 167–169
See application file for complete search history.

(56) References Cited

U.S. PATENT DOCUMENTS

| | | | | | |
|---|---|---|---|---|---|
| 2,083,935 | A | * | 6/1937 | Arnold | 2/161.6 |
| 4,089,069 | A | * | 5/1978 | Vistins | 2/161.8 |
| 4,454,611 | A | * | 6/1984 | Tschirch et al. | 2/8.1 |
| 4,833,733 | A | | 5/1989 | Welch | |
| 5,113,532 | A | * | 5/1992 | Sutton | 2/167 |
| 5,224,363 | A | * | 7/1993 | Sutton | 66/202 |
| 5,253,434 | A | | 10/1993 | Curley, Jr. et al. | |
| 5,423,090 | A | * | 6/1995 | Gimbel | 2/161.7 |
| 5,614,202 | A | | 3/1997 | DeFina | |
| 5,682,613 | A | * | 11/1997 | Dinatale | 2/168 |
| 5,881,572 | A | * | 3/1999 | Plemmons et al. | 66/65 |
| 6,021,523 | A | * | 2/2000 | Vero | 2/159 |
| 6,081,927 | A | * | 7/2000 | Gimbel | 2/161.7 |
| 6,203,872 | B1 | | 3/2001 | Hannon | |
| 6,370,694 | B1 | * | 4/2002 | Michelson | 2/161.7 |
| 6,640,341 | B1 | * | 11/2003 | Calvert | 2/161.6 |
| 6,782,721 | B1 | * | 8/2004 | Vero et al. | 66/171 |
| 6,823,699 | B1 | * | 11/2004 | Vero et al. | 66/171 |
| 7,007,308 | B1 | * | 3/2006 | Howland et al. | 2/161.6 |
| 7,178,171 | B2 | | 2/2007 | Griesbach, III | |
| 7,451,497 | B2 | * | 11/2008 | von Blucher | 2/161.6 |
| 7,934,394 | B2 | * | 5/2011 | Zhu | 66/174 |
| 2002/0076503 | A1 | | 6/2002 | Borreani et al. | |
| 2003/0124354 | A1 | | 7/2003 | Vistins | |

FOREIGN PATENT DOCUMENTS

| | | | |
|---|---|---|---|
| EP | 1563749 | A2 | 1/2005 |
| EP | 1 642 509 | A1 | 4/2006 |
| WO | 2004016121 | A1 | 2/2004 |
| WO | WO200665854 | A3 | 6/2006 |

* cited by examiner

*Primary Examiner* — Danny Worrell
(74) *Attorney, Agent, or Firm* — Boyle Fredrickson S.C.

(57) ABSTRACT

The present invention is a knit or cloth glove that includes one or more additional protective layers attached thereto to improve the protective attributes of the glove as desired by the wearer. The protective layers are formed of materials that provide puncture, cut, chemical and water resistant properties to the glove, and are secured to a base layer of the glove that is formed of a stretchable and breathable natural or synthetic fabric material. An outer coating layer is applied over the base layer and the protective layers to provide enhanced protective features, as well as a seamless appearance, to the glove.

13 Claims, 1 Drawing Sheet

COATED GLOVE WITH MULTIPLE MATERIAL LAYERS

CROSS-REFERENCE TO RELATED APPLICATIONS

This application claims priority from U.S. Provisional Patent Application Ser. No. 61/022,561, filed on Jan. 22, 2008, the entirety of which is expressly incorporated by reference herein.

FIELD OF THE INVENTION

The present invention relates to gloves and more particularly to gloves having protective layers attached thereto to provide certain attributes to the glove, and a coating layer applied over the glove and a portion of the protective layers.

BACKGROUND OF THE INVENTION

When performing certain activities, it is often desirable and even necessary to wear gloves to cover and protect the hands of the individual. These gloves are formed from a wide range of materials and take various forms that can be altered as necessary depending on the particular activity being performed by the individual wearing the gloves, such as participating in sporting events, performing manual labor, or performing medical procedures, among others.

A large number of gloves used in various situations are formed from conventional fabric materials, which allow the individual wearing the glove to properly grasp the object being handled, while also allowing air to circulate through the glove, making the glove more comfortable to wear. However, for certain types of work that involve the handling of potentially hazardous substances or items that can cause damage to the hand of an individual when coming into direct contact with the hand, the benefits of the fabric material forming the glove can be detrimental to the use of the glove in these circumstances In particular, knit gloves, or gloves formed from cloth-like materials have not previously been used for protective purposes because of the nature of the knit or cloth materials, which can easily be torn, cut or punctured, and which readily absorb fluids. Though the knit or cloth gloves are formed from materials that are breathable and stretchable, making the gloves very comfortable to wear, relatively inexpensive and easy to manufacture, these attributes make the gloves formed of these types of materials highly undesirable for use as a glove designed specifically to protect the hand of a wearer.

As a result, in these types of circumstances where the individual wearing the gloves contacts various types of objects, materials, fluids or substances that can be hazardous to the individual if the individual comes into direct contact with those materials, one of the primary considerations for the use of gloves in these situations is the ability of the glove to protect the hand of the individual from damage or injury resulting from direct contact with the objects, fluids or other materials being handled or contacted by the individual wearing the gloves.

Therefore, to enhance the ability of a glove to protect the hand of a wearer, various types of materials have been utilized in the construction of gloves utilized for these purposes. For example, certain types of gloves have been developed that are unitarily formed from materials that are highly resistant to tearing, cutting and/or puncturing, and that are resistant to chemicals and fluids, i.e., waterproof, in order to provide the glove with the desired enhanced protective features. Materials of this type provide a suitable barrier between the hand of the individual positioned within the glove and the substances being handled by the individual that are in contact with the exterior of the glove, to prevent any direct contact between the hand and the substance contacted by the exterior of the glove.

However, as a function of the barrier provided by the unitary material forming the glove that prevents direct contact between the hand and the substance being handled, the material also prevents any gases from entering and circulating through the glove. Thus, the glove does not "breathe", making the glove very uncomfortable to wear for any significant length of time.

For certain uses, gloves have been developed that have both barrier and breathable characteristics, such as gardening gloves in which a knit or cloth glove is partially coated in a dipping process that deposits a protective coating over a portion of the glove, usually the palm portion, and that leaves the remainder of the glove exposed to enable the glove to stretch, flex and breathe as a normal knit glove. However, because the coating does not extend over the entire surface of the knit glove, the glove formed with the dipped coating does not provide the necessary level of protection required for certain tasks.

As a result, it is desirable to develop a glove formed from an inexpensive material that is stretchable, breathable, and easy to manufacture that can be adapted for effective utilization as a protective glove that resists tearing, cutting or puncturing, that is resistant to chemicals and that is waterproof.

SUMMARY OF THE INVENTION

According to one aspect of one embodiment of the present invention, a glove is provided that is formed to have a base layer formed of a fabric, knit or cloth material that provides the glove with the ability to stretch and breathe. Over the knit base layer, the glove has one or more protective layers attached to the glove. These protective layers have various attributes that are not present in the underlying knit base layer, such as puncture, cut and tear resistance properties, a chemical resistance properties and/or a waterproof properties, which can all be present in a single layer or in separate layers disposed on the knit base layer. After the protective layer or layers are applied to the surface of the base layer of the glove, the glove has a suitable coating material applied to a portion of the base layer and the protective layers in order to form a coating layer over a portion of the glove. The coating layer provides additional protective attributes to the glove, and provides a covering for the seam created between the protective layer or layers and the base layer of the glove.

According to another aspect of the present invention, the coating layer can be applied to the glove in a manner that entirely covers one protective layer disposed on one surface of the base layer, and that covers only the peripheral edge of another separate protective layer disposed on a separate surface of the glove.

According to still another aspect of the present invention, the base layer can have a first coating layer applied to the base layer prior to the attachment of the protective layer or layers to the base layer, and then a second coating layer applied to the glove over the first coating layer, the base layer and/or a portion of the protective layers.

Numerous other aspects common features and advantages of the present invention will be made apparent from the following detailed description taken together with the drawing figures.

BRIEF DESCRIPTION OF THE DRAWINGS

The drawings illustrate the best mode currently contemplated for practicing the present invention.

In the drawings.

DETAILED DESCRIPTION OF THE INVENTION

Figure 1:
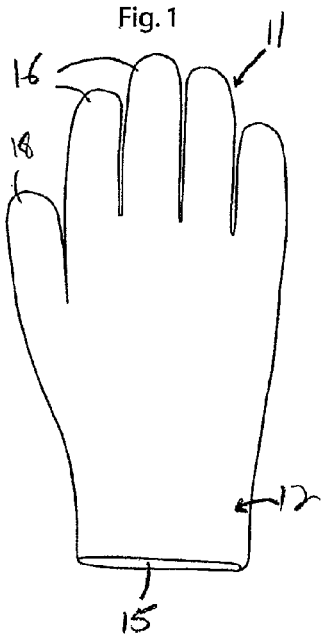
FIG. 1 is a top plan view of a knit glove used in the glove construction of the present invention.

With reference now to the drawing figures in which like reference numerals designate like parts throughout the disclosure, a glove constructed according to the present invention is indicated generally at 10 in FIGS. 1-5. The glove 10 includes a base layer 11 having a back portion 12 and a palm portion 14 secured to one another along their peripheries to form the glove 10. Alternatively, the back portion 12 and the palm portion 14 can be formed partially unitarily with one another along at least a portion of their peripheries. At one end of the glove 10, the back portion 12 and palm portion 14 define a wrist opening 15, while at the other end the back portion 12 and palm portion 14 define a number of finger stalls 16 and a thumb stall 18 adapted to receive the hand (not shown) of an individual. Each of the back portion 12 and palm portion 14 can be, and preferably are formed of any suitable stretchable and breathable fabric, cloth or knittable fibers or materials utilized in the manufacture of gloves, such as cotton and other natural materials, or fibers formed from nylon, rayon, Lycra, or other synthetic materials.

Figure 2:
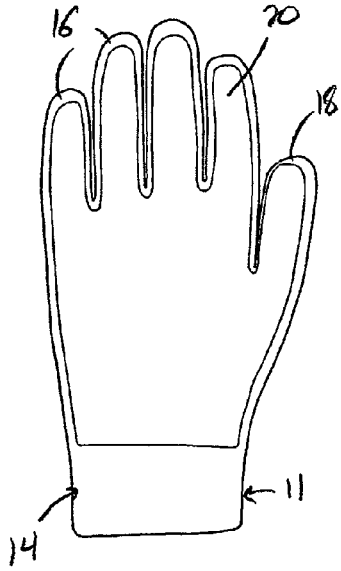
FIG. 2 is a bottom plan view of the glove of FIG. 1 with a first protective layer applied to the bottom of the glove.

As best shown in FIG. 2, the palm portion 14 includes a first protective layer 20 secured thereto that preferably covers the majority of the palm portion 14, as well as the finger stalls 16 and the thumb stall 18. Alternatively, the first protective layer 20 can have any desired configuration, such as covering any number of the finger stalls 16 and the thumb stall 18, as well as any portion of the palm portion 14 either in conjunction or separately from the finger stalls 16 and thumb stall 18, such that the first protective layer 20 can be formed from a number of separate section (not shown) that together form the first protective layer 20. The first protective layer 20 is secured to the palm portion 14 of the base layer 11 in any suitable manner, such as by using stitching, two-sided adhesive tape, thermo-bonding or laminating processes, among any other suitable manners. The first protective layer 20 can be formed of any material having the desired attributes for the palm portion 14, such as insulation, water resistance, or chemical resistance, and, due to the amount of contact with the palm portion 14 of the glove 10 with the items or substance to be held by the glove 10, is preferably formed of a material that provides cut, tear and puncture resistance to the glove 10, such as metal or ceramic reinforced fabric material, optionally in combination with others of these features.

Figure 3:
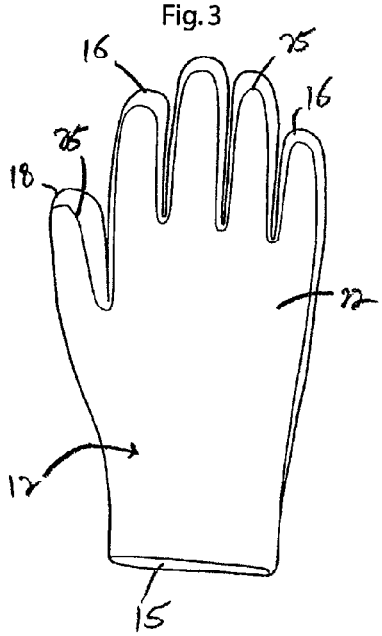
FIG. 3 is a top plan view of the glove of FIG. 1 with a second protective layer applied to the top of the glove.

Referring now to FIG. 3, the back portion 12 of the base layer 11 includes a second protective layer 22 attached to the back portion 12 of the base layer 11. The second protective layer 22 can be affixed to the base layer 11 in any of the manners described previously for use in attaching the first protective layer 20 to the palm portion 14 of the base layer 12. Further, the second protective layer 22 can have a shape similar to that of the first protective layer 20, such that the second protective layer 22 covers the back portion 12, preferably down to the wrist opening 15, as well as the finger stalls 16 and the thumb stall 18, though any shape is suitable for the second protective layer 22 as described previously for the first protective layer 20. The second protective layer 22 can be formed of a material which can be similar to or different from those used for the first protective layer 20 to provide similar protective attributes, but is preferably formed of a synthetic or natural material that is waterproof, stretchable and breathable, such as knit, stretch, or non-stretch material having a secondary laminate or coating layer that is waterproof and breathable, such as a nylon or polyester woven fabric laminated or coated with a film or membrane that provides these properties. In the preferred embodiment, the waterproof, stretchable and breathable material forming the second protective layer 22 allows air to circulate through the glove 10, making the glove 10 much more comfortable to wear.

Figure 4:
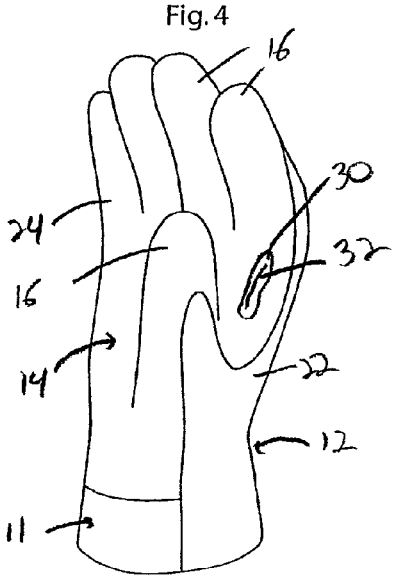
FIG. 4 is a perspective view of the glove of FIG. 3 with a coating layer applied to a portion of the glove.
Figure 5:
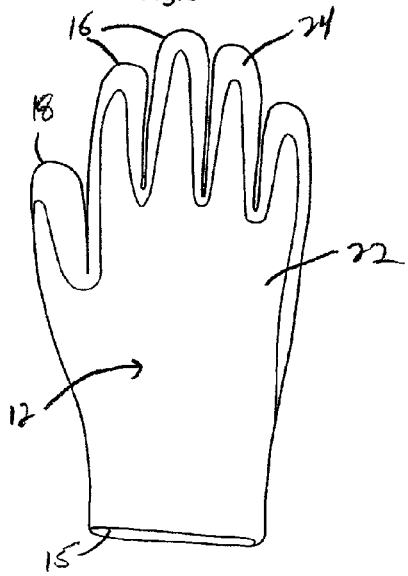
FIG. 5 is a top plan view of the glove of FIG. 4.

Looking now at FIGS. 4 and 5, after the first protective layer 20 and the second protective layer 22 are attached to the base layer 11, the glove 10 can have an outer coating layer 24 applied thereto. The outer coating layer 24 can be formed from any suitable material, such as latex, polyurethane and nitrile, among other materials, in order to render the parts of the glove 10 over which the layer 24 is applied waterproof and resistant to various chemicals. The outer covering layer 24 is applied to the glove 10 in any suitable manner, such as by dipping the glove 10 into the material in liquid form and allowing the material to dry or cure on the glove 10, thus forming the outer coating layer 24. The outer coating layer 24 is formed over a portion of the glove 10, preferably covering at least part of the palm portion 14 and a portion of each finger stall 16 and the thumb stall 18 on the back portion 12, as well as covering the portion, and more preferably the entirety of the first protective layer 20 disposed thereon, while leaving a section of the palm portion 14 adjacent the wrist opening 15 and the majority of the back portion 12 and second protective layer 22 exposed. More preferably, the outer coating layer 24 completely covers the seam created between the peripheral edge 26 of the second protective layer 22 and the back portion 12 of the base layer 11 to provide a seamless appearance to the glove 10.

In an alternative embodiment, the base layer 11 can have an inner coating layer (not shown) applied to the base layer 11 in a pattern similar to the outer coating layer 24 prior to the attachment of either the first protective layer 20 or the second protective layer 22 to the base layer 11. In this embodiment, preferably only the second protective layer 22 secured to the back portion 12 of the base layer 11 is utilized, with the outer coating layer 24 applied to the glove 10 over the inner coating layer and the periphery 26 of the second protective layer 22.

In addition to any of the previous embodiments, as shown in FIG. 4, the glove 10 may also include certain areas 30 in the outer coating layer 24 that are formed in any of a number of suitable masking techniques. These areas 30 can be disposed in any portion of the layer 24 and operate to allow the glove 10 to be more breathable at these locations. Further, the areas 30 can be formed to expose graphics, embossed sections or other indicia 32 that are disposed on the particular layer 11, 20 or 22 and visible through the area 30 in the outer layer 24.

Various alternatives or contemplated as being within the scope of the following claims particularly pointing out and distinctly claiming the subject matter regarded as the invention.

We claim:

1. A glove comprising:

a) a base layer formed from a stretchable and breathable natural or synthetic material;

b) a first protective layer secured to an exterior surface of the base layer; and an outer coating layer disposed on the base layer over at least a portion of the first protective layer, further comprising a second protective layer secured to the exterior surface of the base layer wherein base layer includes a palm portion and a back portion, and wherein the first protective layer is disposed on the palm portion and the second protective layer is disposed on the back portion and wherein the outer coating layer covers the first protective layer and a only peripheral edge of the second protective layer.

2. A glove comprising:

a) a base layer formed from a stretchable and breathable natural or synthetic material;

b) a first protective layer secured to an exterior surface of the base layer; and c) an outer coating layer disposed on the base layer over at least a portion of the first protective layer, further comprising a second protective layer secured to the exterior surface of the base layer wherein base layer includes a palm portion and a back portion, and wherein the first protective layer is disposed on the palm portion and the second protective layer is disposed on the back portion and wherein the first protective layer is a puncture-resistant layer.

3. The glove of claim 2 wherein the second protective layer is a waterproof layer.

4. The glove of claim 2 wherein the first protective layer and the second protective layer are secured to the base layer by laminating, stitching or bonding.

5. The glove of claim 2 wherein the outer coating layer is formed of a waterproof, chemical-resistant material.

6. The glove of claim 2 further comprising an inner protective layer disposed between the base layer and the first and second protective layers.

7. A glove comprising:

a) a base layer formed from a stretchable and breathable natural or synthetic material;

b) a first protective layer secured to an exterior surface of the base layer; and c) an outer coating layer disposed on the base layer over at least a sortion of the first protective layer, further comprising an inner protective layer disposed between the base layer and the first protective layer.

8. A glove comprising:

a) a base layer formed from a stretchable and breathable natural or synthetic material;

b) a first protective layer secured to an exterior surface of the base layer; and c) an outer coating layer disposed on the base layer over at least a sortion of the first protective layer, further comprising at least one breathable area formed in the outer coating layer.

9. A method for forming a protective glove, the method comprising the steps of:

a) providing a base layer formed of a stretchable and breathable natural or synthetic fabric material;

b) attaching a first protective layer to the base layer; and c) applying an outer coating to the base layer and at least a portion of the first protective layer, wherein the first protective layer is a puncture-resistant layer.

10. The method of claim 9 wherein the step of attaching the first protective layer to the base layer comprises laminating, bonding or stitching the first protective layer to the base layer.

11. The method of claim 9 further comprising the step of attaching a second protective layer to the base layer prior to applying the outer coating.

12. The method of claim 11 wherein the step of applying the outer coating comprises positioning the outer coating over a peripheral edge of the second protective layer to provide a seamless appearance to the glove.

13. The method of claim 9 further comprising the step of applying an inner coating layer to the base layer prior to attaching the first protective layer.

* * * * *